United States Patent [19]

Fleak et al.

[11] Patent Number: 4,812,133

[45] Date of Patent: Mar. 14, 1989

[54] FLOATING MOUNTING MEANS FOR ELECTRICAL CONNECTOR ASSEMBLY

[75] Inventors: David S. Fleak, Palmyra; William H. Rose, Harrisburg; Attalee S. Taylor, Palmyra, all of Pa.

[73] Assignee: AMP Incorporated, Harrisburg, Pa.

[21] Appl. No.: 213,557

[22] Filed: Jun. 30, 1988

[51] Int. Cl.[4] ..... H01R 13/74

[52] U.S. Cl. ..... 439/248; 248/27.3; 439/565

[58] Field of Search ..... 439/247, 248, 550, 553, 439/563, 565; 248/27.1, 27.3

[56] References Cited

U.S. PATENT DOCUMENTS

| | | | |
|---|---|---|---|
| 3,213,189 | 10/1965 | Mitchell et al. | 248/27.1 |
| 4,211,905 | 7/1980 | Quigley | 248/27.3 |
| 4,340,795 | 7/1982 | Arthur | 248/27.3 |
| 4,434,339 | 2/1984 | Ohashi | 248/27.3 |
| 4,647,130 | 3/1987 | Blair et al. | 439/248 |
| 4,761,144 | 8/1988 | Hunt, III et al. | 439/545 |

*Primary Examiner*—Gary F. Paumen
*Attorney, Agent, or Firm*—Katherine A. Nelson

[57] ABSTRACT

A floating first electrical connector 11 (such as a receptacle) has a plurality of contacts adapted to mate with complementary contacts carried by a second electrical connector 21 (such as a plug). The receptacle 11 has a limited floating movement within the plane of an opening 12 in a panel 13 (of a power supply or other electrical apparatus) and a retaining clip 17 is snapped over the receptacle 11 (from externally of the power supply) to releasably secure the receptacle 11 on the panel 13, yet accommodate the limited floating movement of the receptacle 11. The receptacle 11 is retained by the retaining clip 17, externally of the power supply, but the receptacle 11 is only accessibly internally of the power supply. The arrangement permits a smooth engagement between the contacts on the plug 21 and receptacle 11, respectively, either by an axial sliding movement or by a relative angular movement therebetween. A flange 28 on the retaining clip covers the opening in the panel 13 and precludes access interiorly of the panel.

17 Claims, 8 Drawing Sheets

FLOATING MOUNTING MEANS FOR ELECTRICAL CONNECTOR ASSEMBLY

FIELD OF THE INVENTION

The present invention relates to a floating mounting means between respective electrical connectors, and more particularly, between at least one floating electrical connector having a plurality of contacts adapted to matingly engage a plurality of complementary contacts on another electrical connector, such that the connectors are self-aligning with respect to each other.

BACKGROUND OF THE INVENTION

In the prior art relating to electrical apparatus, cooperating electrical connectors (which, for instance, may constitute a plug and a receptacle, respectively) are well known. In the manufacture and assembly of the electrical apparatus, tolerance accumulations may be encountered which tend to interfere with the smooth slidable reception of one electrical connector into the mating electrical connector. For example, the electrical apparatus may be carried on a slidable drawer as part of a rack of electronic equipment, and the drawer may have some degree of misalignment within the rack. In an effort to alleviate this problem, the prior art has resorted to a type of "floating" mounting means.

Such a floating mounting means is exemplified by U.S. Pat. No. 4,647,130 issued to Blair et al on Mar. 3, 1987, and assigned to the assignee of the present invention. In this Blair et al '130 patent, the unthreaded shank portions of shoulder screws extend through mounting holes formed in the plug (and/or receptacle) such that each shoulder screw has a head portion which is larger than a respective mounting hole. Each mounting hole has a pair of opposed projections extending forwardly therefrom; and an elastomeric member is disposed elastically around the opposed projections across each mounting hole. Each elastomeric member has an elongated shape with respective sides elastically engaging the unthreaded shank portion of a respective shoulder screw, and each shoulder screw extends through its respective mounting hole and is secured to a respective panel by means of a cooperating threaded nut. With this arrangement, the plug (with its female contacts) has an initial floating mount. Guide pins extend forwardly of the plug housing and are received in respective alignment recesses in the receptacle housing, thereby tending to cam the plug into alignment with the receptacle. This camming action is accommodated by the resilient mounting of the plug; and once the plug is received into the receptacle, the nuts are thereafter tightened on the respective shoulder screws to solidly retain the plug and connector (and its associated respective electrical apparatus).

Moreover, in co-pending application, Ser. No. 06/944,314 filed on Dec. 22, 1986, now U.S. Pat. No. 4,761,144, and also assigned to the assignee of the present invention, the housing for an electrical connector (having female contacts) is provided with opposed transverse slots for receiving the respective edges of a panel, thereby longitudinally retaining the connector on the panel while permitting a limited lateral movement of the connector with its female contacts.

While these prior art arrangements are perfectly satisfactory for the purposes intended, nevertheless, a need exists for providing a limited (radial) floating movement of an electrical connector, wherein the floating electrical connector is retained in its respective electrical assembly and is only accessible internally thereof.

SUMMARY OF THE INVENTION

Accordingly, it is an object of the present invention to provide a floating electrical connector having a plurality of contacts adapted to mate with complementary contacts carried by a second electrical connector, such that the respective electrical connectors are inherently self-aligning with respect to each other, thereby accommodating a blind mating therebetween.

It is another object of the present invention to provide an electrical connector having a limited floating movement within an opening formed on a panel of a respective electrical assembly, wherein the floating electrical connector has a plurality of contacts having a conjoint floating movement therewith.

It is yet another object of the present invention to provide a floating electrical connector, wherein the floating electrical connector is accessible only from the interior of its associated electrical apparatus, and wherein a retainer releasably engages the floating electrical connector from externally of its associated electrical apparatus.

It is a further object of the present invention to provide a pair of mating electrical connectors, at least one of which has a floating mount, such that the connectors are adapted to mate by an axial sliding movement or by a relative angular movement therebetween.

In accordance with the teachings of the present invention, there is herein illustrated and described, for use in combination with a pair of electrical apparatuses including a first electrical apparatus having a first electrical connector provided with a plurality of contacts, and further including a second electrical apparatus having a second electrical connector provided with a plurality of complementary contacts adapted to matingly engage the respective plurality of contacts on the first connector, an improvement which includes a floating mounting means for the respective electrical connector in at least one of the electrical apparatuses. With this arrangement, the respective electrical connector has a limited floating movement substantially in a plane which is transverse to the mating engagement of the complementary contacts on the respective connectors, such that the respective electrical connectors are substantially self-aligning and substantially accommodate a blind mating therebetween. The floating mounting means further includes a retaining means for the respective electrical connector. This retaining means is insertable into the one electrical apparatus from externally thereof to releasably engage the respective floating electrical connector. With this arrangement, the retaining means thereafter precludes access past the respective electrical connector to the interior of the one electrical apparatus, and the retaining means is releasable only from the interior of the one electrical apparatus.

In a preferred embodiment, the one electrical apparatus includes a panel having an opening formed therein, and the floating mounting means accommodates a limited floating movement of the respective electrical connector within the opening in the panel.

While the teachings of the present invention are not necessarily confined thereto, the respective floating electrical connector (in one embodiment) comprises a receptacle having a plurality of male contacts.

Preferably, the retaining means comprises a retainer clip having a pair of spaced ears, each of which is provided with a downwardly-projecting hook; and the respective floating electrical connector has a rearward face engaged by the respective hooks as the retaining clip is passed through the opening in the panel and is snapped over the respective floating electrical connector.

Additionally, a cooperating guide means may be associated with the respective electrical connectors, thereby assuring a substantially smooth engagement between the complementary mating contacts on the respective connectors.

In accordance with the further teachings of the present invention, there is herein illustrated and described, a preferred embodiment of a floating mounting means for an electrical connector assembly. The assembly includes a panel having first and second sides and further having an opening formed therein. A first electrical connector, having a plurality of contacts, is received through the opening in the panel from a first side thereof and extends beyond the second side thereof. The opening in the panel is larger than the outer contours of the first electrical connector, such that the first electrical connector may float within the plane of the panel within the limits of the opening therein, and such that a portion of the first electrical connector extends through the opening in the panel and beyond the second side thereof. A retaining clip has at least a portion thereof received through the opening in the panel from the second side thereof and extends beyond the first side of the panel internally of the panel for releasably engaging the first electrical connector, thereby retaining the first electrical connector in the panel, but accommodating a limited floating movement of the first electrical connector in the plane of the panel. A second electrical connector, provided with complementary mating contacts, is adapted to mate with the floating first electrical connector.

In one embodiment (and while the teachings of the present invention are not confined thereto) the floating first electrical connector may comprise a floating receptacle in a power supply, and the second electrical connector may comprise a plug carried by a backplane adapted to be energized by the power supply, wherein the floating receptacle has a plurality of male contacts adapted to mate with complementary female contacts carried by the plug connector.

Viewed in yet another aspect, the present invention provides a first electrical apparatus (such as a power supply) having a floating electrical connector (such as a receptacle) provided with a plurality of contacts; and a second electrical apparatus (such as a backplane) has a plug provided with a plurality of complementary contacts adapted to engage the contacts on the floating receptacle. A retainer releasably engages the receptacle from externally of the first electrical apparatus, such that the receptacle (and the retainer secured thereto) is accessible only from the interior of the first electrical apparatus. The receptacle extends beyond the retainer outwardly of the first electrical apparatus for slidably receiving the plug, whereby the floating receptacle and the contacts carried thereby accommodate tolerance accumulations between the first and second electrical apparatuses, respectively.

These and other objects of the present invention will become apparent from a reading of the following specification, taken in conjunction with the enclosed drawings.

DESCRIPTION OF THE PREFERRED EMBODIMENTS

Figure 1:
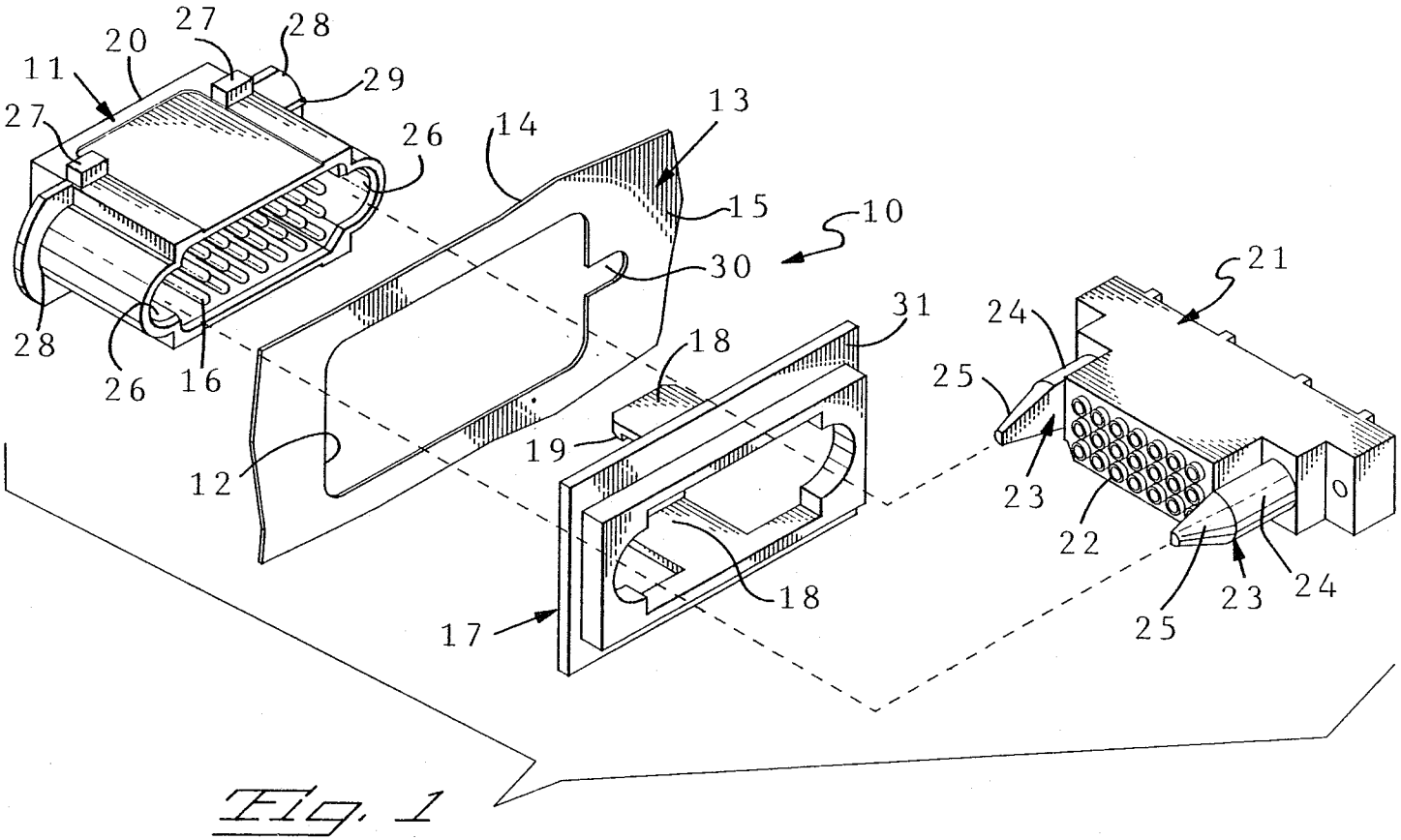
FIG. 1 is an exploded perspective view of the floating mounting means of the present invention, including the following major components: a floating receptacle (or first electrical connector) having a plurality of contacts; a panel (of a first electrical apparatus) having an opening formed therein to receive the floating receptacle; a retainer clip adapted to be snapped into place over the receptacle from externally of the first electrical apparatus; and a plug (or second electrical connector) having a plurality of complementary contacts adapted to mate with the respective contacts in the floating receptacle.
Figure 2:
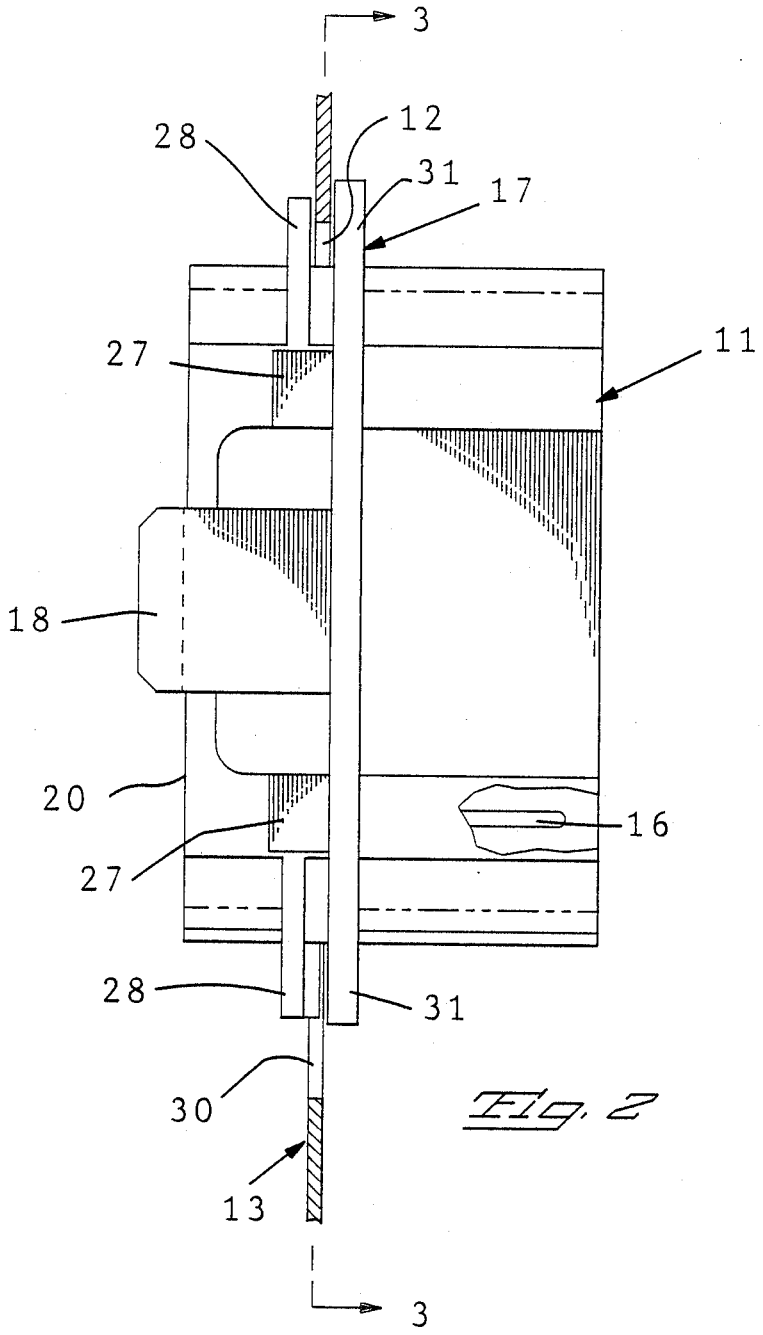
FIG. 2 is a top plan view of the panel, the floating receptacle within the opening in the panel, and the retaining clip snapped over the receptacle to prevent the receptacle from being dislodged transversely of the panel, yet accommodating a limited floating movement of the receptacle within the plane of the opening in the panel.

With reference to FIGS. 1 and 2 of the drawings, there is illustrated a preferred embodiment of the floating mounting means 10 of the present invention.

It will be appreciated by those skilled in the art that the teachings of the present invention are equally applicable to a wide variety of electrical apparatuses; as for example, the following: drawers in a rack; cable-to-cabinet connectors; cabinet-to-cabinet connections; modular electrical (or electronic) equipment; and the like. Moreover, it will also be appreciated that the teachings of the present invention are equally applicable to electrical and optical transmission members, which use electrical power and signal transmission or fibers for optical signal transmission. Finally, the invention is applicable to a floating mounting means for either one (or both) of the mating electrical connectors, such as a cooperating plug and receptacle. Accordingly, it will be understood that the following description of the preferred embodiment of the present invention is exemplary only and is not intended to limit the scope of the invention.

Figure 3:
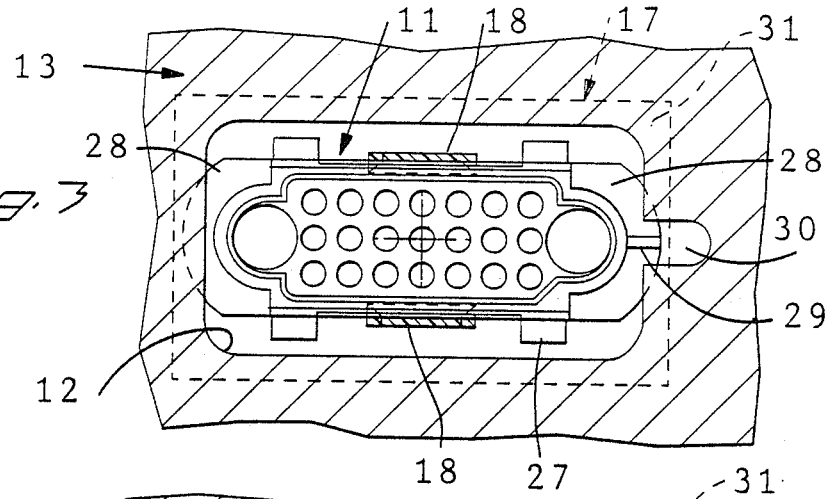
FIG. 3 is a cross-sectional view, taken along the lines 3—3 of FIG. 2, and illustrating the limited floating movement of the receptacle (and the retaining clip releasably secured thereto) within the confines of the opening in the plane of the panel, the broken lines illustrating how the flange on the retaining clip covers the opening in the panel and prevents access to the interior of the first electrical apparatus (such as a power supply) having the floating receptacle (or other floating electrical connector thereon).
Figure 4:
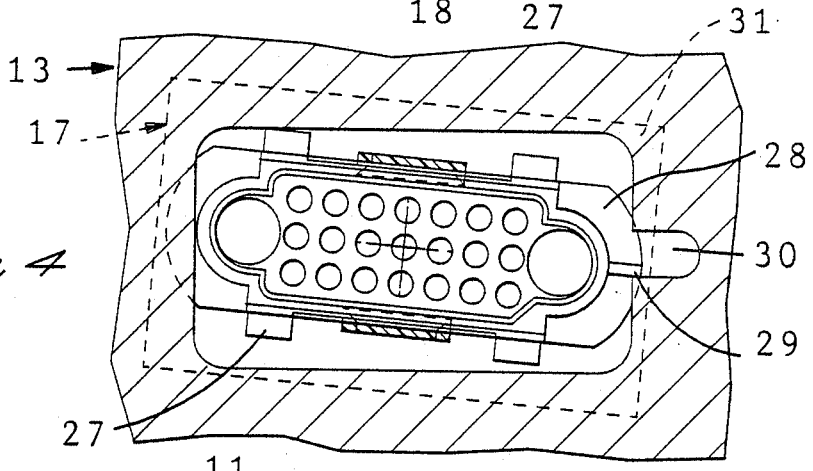
FIGS. 4 and 5 are further cross-sectional views, corresponding substantially to FIG. 3, but further illustrating the limited floating movement of the receptacle.
Figure 5:
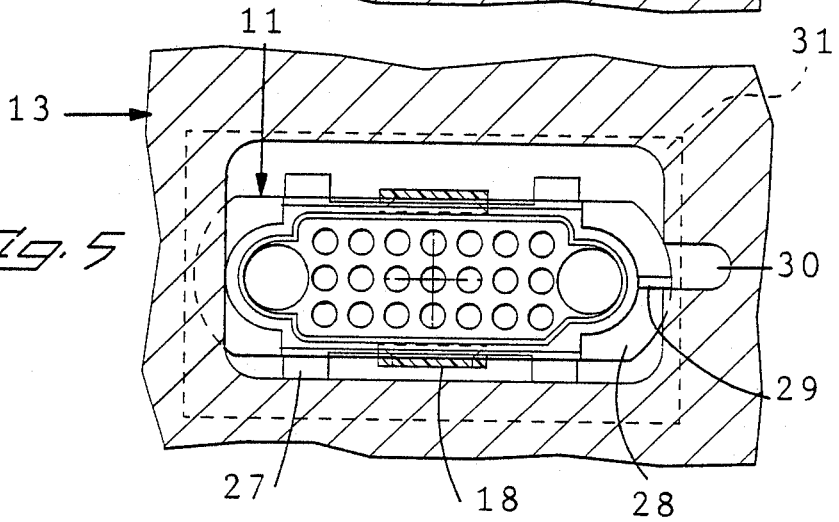

With this in mind, the floating mounting means 10 of the present invention includes a receptacle 11 having a limited floating movement within an opening 12 formed in a panel 13. The panel 13, for example, may be part of a power supply (which, being conventional, has been omitted for ease of illustration). The respective dimensions of the opening 12 are slightly larger than the outer dimensions, contours or configuration of the receptacle 11, such that the receptacle 11 (as shown more clearly in FIGS. 3–5) may have a limited floating movement within the opening 12 in the panel 13.

The floating receptacle 11 is received through the opening 12 in the panel 13, from a first (interior) side 14 of the panel 13, and extends beyond a second (exterior) side 15 of the panel 13, as shown more clearly in FIG. 2. The floating receptacle 11 has a plurality of contacts 16 that have a conjoint floating movement with the receptacle 11. In the embodiment shown herein, the receptacle 11 has a plurality of male contacts 16.

Figure 6:
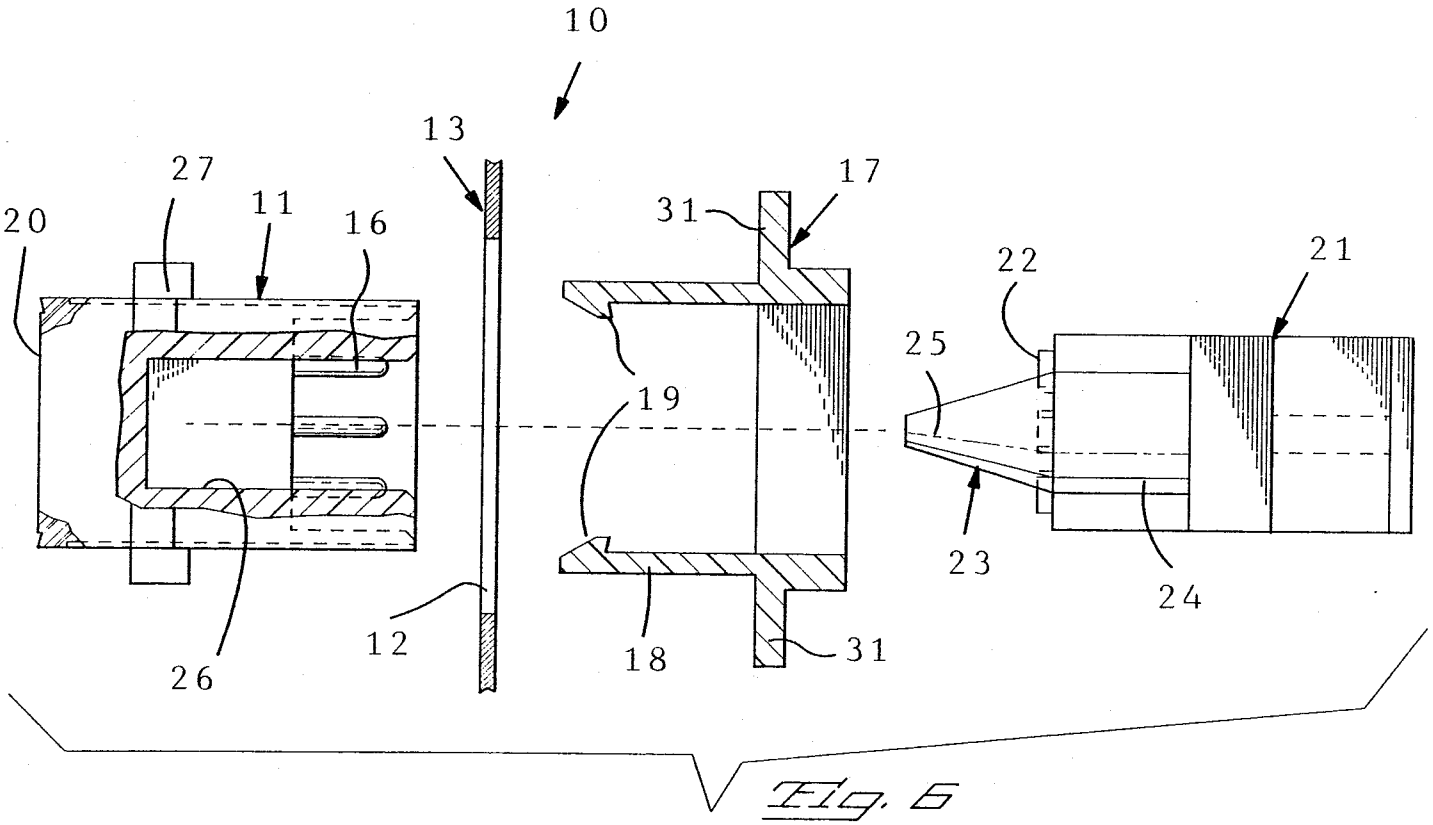
FIG. 6 is an exploded longitudinal section of the major components of the floating mounting means of the present invention.
Figure 7A:
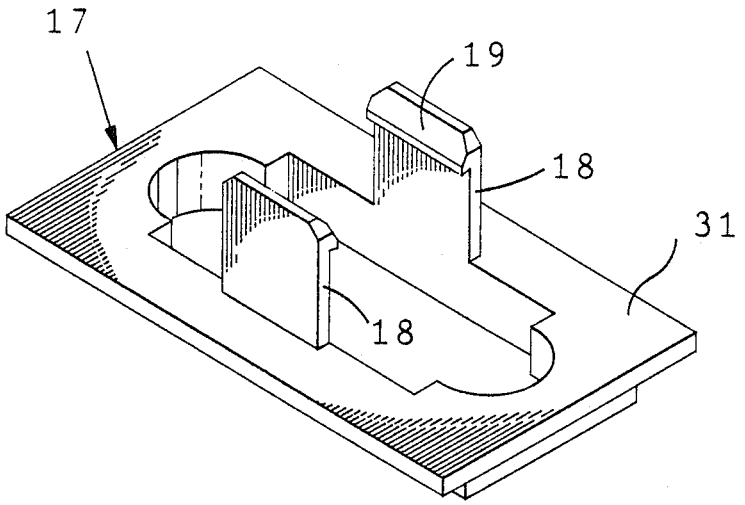
FIG. 7A is a perspective of the preferred retaining clip of the present invention, showing the spaced latching tabs with their respective hooks to releasably engage the floating receptacle.
Figure 7B:
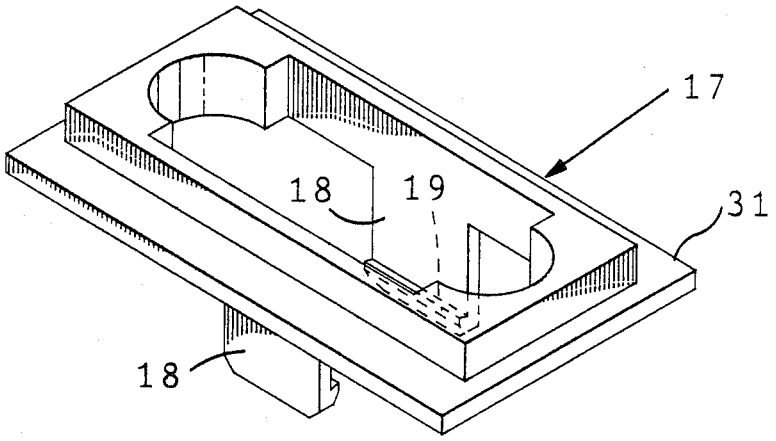
FIG. 7B is a further perspective view of the preferred retaining clip, viewed from its opposite side.
Figure 8:
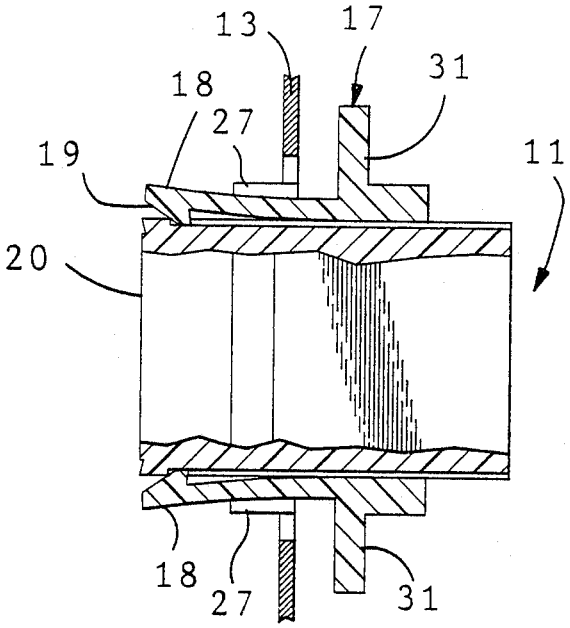
FIG. 8 is a longitudinal cross-sectional view of the retaining clip as it is being assembled over the floating receptacle.
Figure 9:
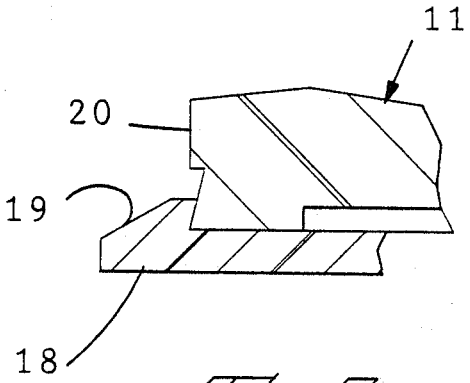
FIG. 9 corresponds to a portion of FIG. 8 and illustrates how the respective downwardly-projecting hooks on the spaced-apart ears on the retaining clip are snapped over the rearward face of the floating receptacle, thereby preventing dislodgement of the receptacle transversely of the opening in the panel, yet accommodating the limited floating movement of the receptacle within the opening in the panel.

A retaining clip 17, as shown in FIGS. 6, 7A and 7B, has an opening 18 suitably configured to allow a portion of the receptacle 11 to extend therethrough externally of the panel 13. The retaining clip 17 has a pair of inwardly-extending latching tabs or ears 18, each of which is provided with a downwardly-extending hook 19. Each tab 18 flexes outwardly as the retaining clip 17 is slidably received over the receptacle 11, as shown in FIG. 8, such that the hooks 19 are received over the rearward face 20 of the receptacle 11 as the retaining clip 17 is "snapped" over the receptacle 11 to thereby releasably secure the receptacle 11 within the panel 13, as shown more clearly in FIGS. 8 and 9. It is to be understood that configuration of the tabs or latching member shown is representative of a variety of possible designs.

With this arrangement, the receptacle 11 is retained against dislodgement from the panel 13 in a direction transverse to the panel 13, yet the retaining clip 17 accommodates a limited floating movement of the receptacle 11 within the plane of the opening 12 in the panel 13. Moreover, it will be appreciated that the receptacle 11 enters the opening 12 in the panel 13 externally thereof; such that while the floating receptacle 11 is engageable by the retaining clip 17 externally of the power supply, (or other electrical apparatus) the floating receptacle 11 may only be removed from the power supply internally thereof.

Moreover, the retaining clip 17 has a flange 28 which covers the opening 12 in the panel 13. With this arrangement, and once the retaining clip 17 is snapped into place, the interior of the power supply (or other electrical apparatus) is not accessible from externally thereof.

The floating receptacle 11 (with its male contacts 16) cooperates with a "header" or plug connector 21 having a plurality of female contacts 22. While not limited thereto, in the preferred embodiment the plug 21 is carried by a backplane (which, being conventional, has been omitted for ease of illustration).

The plug 21 is provided with a pair of spaced-apart guide pins or posts 23. Each guide post 23 has a first portion 24 formed substantially as a semi-cylinder; and each guide post 23 further has a second portion 25 integral with the first portion 24, extending forwardly therefrom, and having a conical or tapered configuration (as shown more clearly in FIG. 1). These guide posts 23 cooperate with complementary formed semi-cylindrical recesses 26 formed within the floating receptacle 11. It will be understood, however, that other forms of guide means may be employed.

Figure 10:
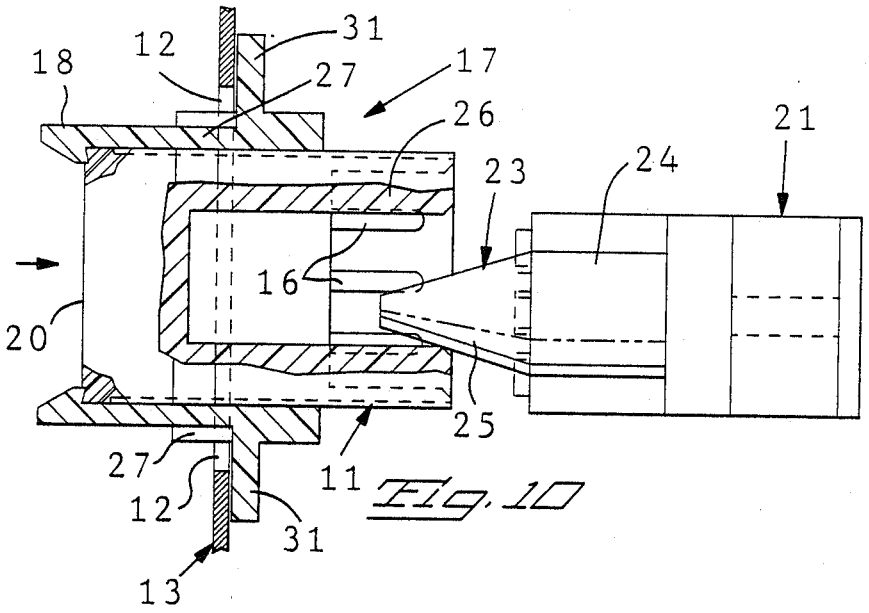
FIG. 10 is a further longitudinal cross-sectional view of the assembled receptacle and retaining clip, showing in exploded relationship the plug as it is being slidably guided into the floating receptacle.
Figure 11:
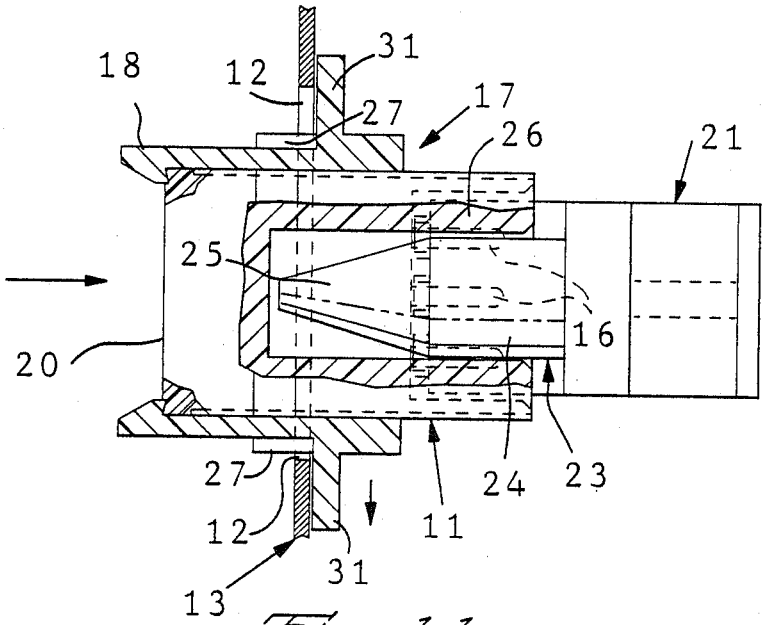
FIG. 11 corresponds to FIG. 10, but illustrates how the floating receptacle will shift within the plane of the opening in the panel, as the plug engages the receptacle, thereby accommodating tolerance accumulations between the plug and its mating receptacle.

As shown more clearly in FIGS. 10 and 11, as the plug 21 is slidably received within the receptacle 11, the guide posts 23 align the floating receptacle 11 with the plug 21 and, if necessary, cam the floating receptacle 11 into alignment with the plug 21, such that the contacts 22 on the plug 21 smoothly receive the complementary contacts 16 on the floating receptacle 11 (and vice-versa).

Figure 12:
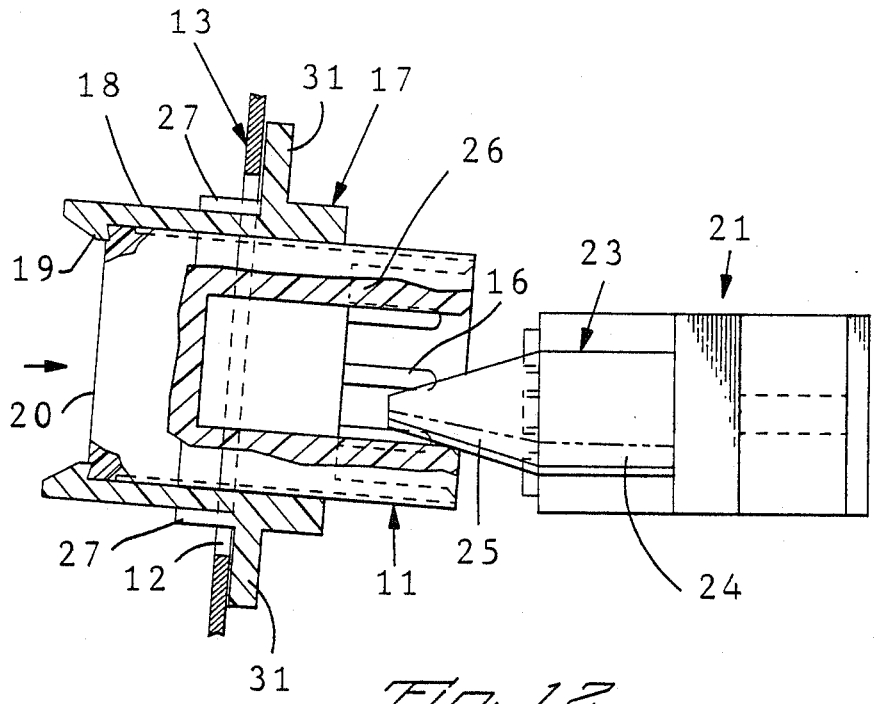
FIG. 12 is a further exploded cross-sectional view, showing how the plug and the floating receptacle may engage each other at a relative angular relationship (as well as by an axial sliding movement, as previously illustrated).

The cooperating plug 21 and receptacle 11 may engage by means of an axial sliding movement, such as a drawer in a rack as illustrated in FIGS. 10 and 11, or by a relative angular movement therebetween (as shown more clearly in FIG. 12).

The receptacle 11, retaining clip 17 and plug 21 may be molded from a suitable dielectric material.

Preferably, the receptacle 11 has two pairs of projecting tabs 27 constituting a locating or positioning means for cooperating with the flange 31 on the retaining clip 17 (as shown more clearly in FIG. 2) to assure that when hooks 19 on the ears 18 of the retaining clip 17 engage the floating receptacle 11, that there is some "play" (transversely of the plane of the panel 13) so that the retaining clip 17 does not rigidly bind the receptacle 11 within the opening 12 of the panel 13 but, rather, accommodates the limited floating movement of the receptacle 11 within the plane of the panel 13.

Additionally, the floating receptacle 11 has a raised portion 29 received within a keyhole slot 30 communicating with the opening 12 in the panel 13. The keyhole slot 30 provides clearance for the raised portion 29 and thus assures that the floating receptacle 11 will be properly oriented within the opening 12 and not laterally reversed in an alternate 180° orientation.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A floating mounting means for an electrical apparatus including first and second electrical apparatuses, respectively, the floating mounting means comprising:

a panel of the first electrical apparatus, the panel having first and second sides and further having an opening formed therein;

a first electrical connector of the first apparatus and having a plurality of contacts, the first connector being received through the opening in the panel from the first side thereof and extending beyond the second side thereof, the opening being larger than the outer contours of the first connector, such that the first connector may float within the plane of the panel within the limits of the opening formed therein;

a retainer having at least a portion thereof received through the opening in the panel from the second side thereof and extending beyond the first side of the panel for releasably engaging the first connector, thereby retaining the first connector in the panel, but accommodating a limited floating movement of the first connector in the plane of the panel, the retainer having a flange covering the opening in the panel, such that the interior of the first electrical apparatus is not accessible from the second side of the panel; and the second electrical apparatus including a second electrical connector having complementary contacts adapted to mate with the contacts on the floating first electrical connector, whereby the respective first and second electrical connectors are substantially self-aligning and accommodate a substantially blind mating therebetween.

2. The floating mounting means of claim 1, wherein the first electrical connector comprises a floating receptacle having a plurality of male contacts, and wherein the second electrical connector comprises a plug having a plurality of female contacts.

3. The floating mounting means of claim 2, wherein the first electrical apparatus comprises a power supply, and wherein the floating receptacle having the male contacts provides a power connection.

4. The floating mounting means of claim 2, further including a pair of spaced guide posts carried by the plug, and the receptacle having a pair of complementary spaced openings formed therein to receive the guide posts on the plug, thereby accommodating an alignment between the plug carrying the female contacts and the floating receptacle carrying the male contacts, as the plug is slidably received into the receptacle.

5. The floating mounting means of claim 4, wherein each guide post has a first portion having a substantially semi-cylindrical configuration, and further has a second portion formed integrally with the first portion, extending therefrom, and having a substantially tapered configuration, thereby facilitating the slidable reception of the plug into the receptacle and the alignment therebetween.

6. The floating mounting means of claim 1, wherein the retainer comprises a retaining clip having a pair of latching ears carried thereby and projecting therefrom through the opening in the panel, each of the ears having a downwardly-projecting hook formed thereon, and wherein the floating first electrical connector has a rearward face engaged by the hooks on the respective ears, as the retaining clip is snapped over the first electrical connector, thereby releasably securing the first electrical connector to the panel, but accommodating a floating movement of the first electrical connector within the opening in the panel.

7. The floating mounting means of claim 6, wherein the floating first electrical connector has a portion thereof extending through the opening in the panel and beyond the second side thereof, the first electrical connector further having a plurality of locating tabs engaging the retaining clip for limiting the extent to which the first electrical connector extends beyond the panel, whereby the first electrical connector and the retaining clip releasably secured thereto have a limited movement in a direction transverse to the plane of the panel, thereby avoiding a binding of the first electrical connector relative to the panel and facilitating the limited floating movement of the first electrical connector within the plane of the opening in the panel.

8. The floating mounting means of claim 1 further including means for keying said connector in said panel opening.

9. A floating mounting means for an electrical apparatus including first and second electrical assemblies, respectively, the floating mounting means comprising:

a panel of the first electrical assembly, the panel having first and second sides and further having an opening formed therein;

a first electrical connector of the first assembly having a plurality of contacts, the first electrical connector being received through the opening in the panel from the first side thereof and extending beyond the second side thereof, the opening being larger than the outer contours of the first connector, such that the first connector may float within the plane of the panel within the limits of the opening formed therein, and such that a portion of the first connector extends through the opening in the panel and beyond the second side thereof;

a plurality of locating tabs on the first connector;

a retaining clip engaging the locating tabs on the first connector, said retaining clip having a pair of latching ears projecting therefrom through opening in the panel and into the first electrical assembly, each of the ears having a downwardly-projecting hook formed thereon, the first connector having a rearward face engaged by the hooks on the respective ears, as the retaining clip is snapped over the first connector, thereby releasably securing the first connector to the panel, but accommodating a limited floating movement of the first connector in the plane of the panel, the retaining clip further including a flange covering the opening in the panel, such that the interior of the first electrical assembly is not accessible from the second side of the panel on the first electrical assembly;

a second electrical connector of the second assembly and having a plurality of complementary contacts adapted to matingly engage the contacts on the floating first connector; and guide means carried by the first and second electrical connectors, respectively, whereby the first and second electrical connectors are substantially self-aligning and accommodate a substantially blind mating therebetween.

10. An electrical apparatus, comprising:

a power supply including a panel having an opening formed therein;

a first electrical connector within the power supply and accessible externally of the power supply from the opening in the panel thereof;

retention means releasably engaging the first electrical connector from externally of the power supply, such that the first electrical connector can only be removed from the power supply from interior thereof, the retention means accommodating a limited floating movement of the first electrical connector in the opening in the panel and substantially in the plane thereof;

a plurality of contacts in the first electrical connector and having a conjoint limited floating movement therewith;

a second electrical connector carried by the electrical assembly adapted to be energized by the power supply and having a plurality of complementary contacts adapted to mate with the contacts in the floating first electrical connector, respectively; and cooperating guide means on the first and second electrical connectors, respectively, for facilitating the slidable engagement of the first and second electrical connectors, and the floating movement of the first electrical connector facilitating a self alignment between the connectors and the blind mating therebetween.

11. The electrical apparatus of claim 10, wherein the retention means comprises a retaining clip received through the opening in the panel externally of the power supply, the retaining clip having a pair of spaced-apart planar ears, each of which is provided with a downwardly-projecting hook, and wherein the floating first electrical connector has a rearward face adapted to be engaged by the respective hooks, as the ears on the retaining clip are slidably received over the first electrical connector and snapped over the rearward face thereof.

12. An electrical apparatus, comprising:

a power supply having a floating receptacle which floats relative to the power supply and is provided with a plurality of contacts;

an electrical assembly adapted to be energized by the power supply and having a plug connector provided with a plurality of complementary contacts adapted to engage the contacts on the floating receptacle; and a retainer releasably engaging the receptacle externally of the power supply, such that the retainer may be released from the receptacle only from the interior of the power supply, the receptacle extending beyond the retainer outwardly of the power supply for slidably receiving the plug connector, whereby the floating receptacle and the contacts carried thereby accommodate tolerance accumulations between the power supply and the electrical assembly, respectively, and facilitate an angular movement therebetween.

13. In combination with a pair of electrical apparatuses including a first electrical apparatus having a first electrical connector provided with a plurality of contacts, and further including a second electrical apparatus having a second electrical connector provided with a plurality of complementary contacts adapted to matingly engage the respective plurality of contacts on the first connector, the improvement which comprises:

a floating mounting means for a respective said electrical connector in at least one of the electrical apparatuses, such that said respective electrical connector has a limited floating movement substantially in a plane which is transverse to the direction of mating engagement of the complementary contacts on the respective connectors, and such that the respective electrical connector is substantially self-aligning and substantially accommodate a blind mating between the connectors, said floating mounting means including retaining means for said respective electrical connector, said retaining means being insertable into the respective said electrical apparatus from externally thereof to releasably engage the respective said electrical connector, wherein said retaining means thereafter precludes access past the respective said electrical connector to the interior of the respective said electrical apparatus, and wherein said retaining means is releasable only from the interior of the respective said electrical apparatus.

14. The improvement of claim 13, wherein one said electrical connector comprises a receptacle having a plurality of male contacts.

15. The improvement of claim 13, wherein one of said electrical appratii includes a panel having an opening formed therein, and wherein said floating mounting means accommodates a limited floating movement of one said electrical connector within the opening in the panel.

16. The improvement of claim 15, wherein said retaining means comprises a retainer clip having a pair of spaced ears, each of which is provided with a downwardly-projecting hook, and wherein the respective said electrical connector has a rearward face engaged by said respective hooks as the retaining clip is passed through the opening in the panel and is snapped over the respective said electrical connector.

17. The improvement of claim 13, further including cooperating guide means associated with said electrical connectors, thereby assuring a substantially smooth engagement between the complementary mating contacts on said connectors.

* * * * *

UNITED STATES PATENT OFFICE

CERTIFICATE OF CORRECTION

Patent No. 4,812,133 Dated March 14, 1989

Inventor(s) David Scott Fleak et al.

It is certified that error appears in the above-identified patent and that said Letters Patent is hereby corrected as shown below:

In the Abstract, Line 17, change "28" to --31--.

Column 6, Line 6, change "28" to --31--.

Column 6, Line 55, insert --flange 28 of-- after "Additionally,".

Signed and Sealed this

Thirty-first Day of October, 1989

*Attest:*

DONALD J. QUIGG

*Attesting Officer*

*Commissioner of Patents and Trademarks*